US005611911A

United States Patent [19]

Edmondson

[11] Patent Number: 5,611,911

[45] **Date of Patent: *Mar. 18, 1997**

[54] HIGH TEMPERATURE CORROSION INHIBITOR

[75] Inventor: James G. Edmondson, Conroe, Tex.

[73] Assignee: BetzDearborn Inc., Trevose, Pa.

[ * ] Notice: The term of this patent shall not extend beyond the expiration date of Pat. No. 5,611,911.

[21] Appl. No.: 587,439

[22] Filed: Jan. 17, 1996

Related U.S. Application Data

[63] Continuation of Ser. No. 213,293, Mar. 15, 1994, Pat. No. 5,500,107.

[51] Int. Cl.[6] ..... C10G 9/12

[52] U.S. Cl. ..... 208/47; 208/48 AA; 208/48 R

[58] Field of Search ..... 208/47, 48 R, 208/48 AA

[56] References Cited

U.S. PATENT DOCUMENTS

| | | | |
|---|---|---|---|
| 2,899,387 | 8/1959 | Fierce et al. | 208/348 |
| 4,842,716 | 6/1989 | Kaplan et al. | 208/48 AA |
| 5,354,450 | 10/1994 | Tong et al. | 208/48 AA |

FOREIGN PATENT DOCUMENTS

| | | |
|---|---|---|
| 0286140 | 4/1988 | European Pat. Off. . |
| 0552863 | 1/1993 | European Pat. Off. . |
| 863630 | 4/1941 | France . |
| 9414923 | 7/1994 | WIPO . |

*Primary Examiner*—Glenn A. Caldarola
*Assistant Examiner*—Bekir L. Yildirim
*Attorney, Agent, or Firm*—Alexander D. Ricci; Richard A. Paikoff

[57] ABSTRACT

A process for the inhibition of corrosion caused by naphthenic acid and sulfur compounds during the elevated temperature processing of crude oil by use of an aryl containing phosphite compound having one of the structures:

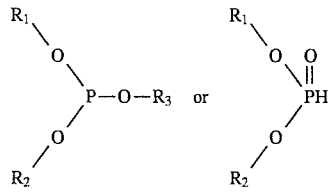

wherein $R_1$, $R_2$ and $R_3$ are $C_6$ to $C_{12}$ and at least one R group is an aryl radical.

4 Claims, No Drawings

HIGH TEMPERATURE CORROSION INHIBITOR

This is a continuation of application Ser. No. 08/213,293 filed Mar. 15, 1994, now U.S. Pat. No. 5,500,107.

FIELD OF THE INVENTION

This invention relates generally to a process for inhibiting corrosion in refining operations. It is specifically directed toward the inhibition of corrosion caused by naphthenic acids and, less frequently, sulfur compounds which are present in the crude oil.

BACKGROUND OF THE INVENTION

Corrosion problems in petroleum refining operations associated with naphthenic acid constituents and sulfur compounds in crude oils have been recognized for many years. Such corrosion is particularly severe in atmospheric and vacuum distillation units at temperatures between 400° F. and 790° F. Other factors that contribute to the corrosivity of crudes containing naphthenic acids include the amount of naphthenic acid present, the concentration of sulfur compounds, the velocity and turbulence of the flow stream in the units, and the location in the unit (e.g., liquid/vapor interface).

In the distillation refining of crude oils, the crude oil is passed successively through a furnace and one or more fractionators such as an atmospheric tower and a vacuum tower. In most operations, naphthenic acid corrosion is not a problem at temperature below about 400° F. Traditional nitrogen-based filming corrosion inhibitors are not effective at temperatures above 400° F. and the other approaches for preventing naphthenic acid/sulfur corrosion such as neutralization present operational problems or are not effective.

It should be observed that the term "naphthenic acid" includes mono and di-basic carboxylic acids and generally constitutes about 50% by weight of the total acidic components in crude oil. Many of the naphthenic acids may be represented by the following formula:

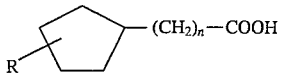

where R is an alkyl or cycloalkyl and n ranges generally from 2 to 10.

Many variations of this structure and molecular weight are possible. Some practitioners include alkyl organic acids within the class of naphthenic acids.

Naphthenic acids are corrosive between the range of about 400° F. (210° C.) to 790° F. (420° C.). At the higher temperatures the naphthenic acids are in the vapor phase and at the lower temperatures the corrosion rate is not serious. The corrosivity of naphthenic acids appears to be exceptionally serious in the presence of sulfide compounds, such as hydrogen sulfide, mercaptans, elemental sulfur, sulfides, disulfides, polysulfides and thiophenols.

Efforts to minimize or prevent the naphthenic acid/sulfur corrosion have included the following approaches:

(a) blending of higher naphthenic acid content oil with oil low in naphthenic acids;

(b) neutralization and removal of naphthenic acids from the oil; and (c) use of corrosion inhibitors.

Because these approaches have not been entirely satisfactory, the accepted approach in the industry is to construct the distillation unit, or the portions exposed to naphthenic acid/sulfur corrosion, with the resistant metals such as high quality stainless steel or alloys containing higher amounts of chromium and molybdenum. However, in units not so constructed there is a need to provide inhibition treatment against this type of corrosion. The prior art corrosion inhibitors for naphthenic acid environments include nitrogen-based filming corrosion inhibitors. However, these corrosion inhibitors are relatively ineffective in the high temperature environment of naphthenic acid oils.

DETAILED DESCRIPTION OF THE INVENTION

The present invention provides a method for inhibiting the corrosion of the internal metallic surfaces of the equipment used in processing crude oil. It consists of adding to the crude oil an effective amount, sufficient to inhibit corrosion, of a phosphite compound containing at least one aryl group represented by either of the following structures:

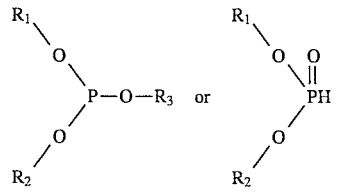

wherein $R_1$, $R_2$ and $R_3$ are $C_6$ to $C_{12}$ and at least one R group is aryl.

The aryl containing phosphites of the present invention are commercially available and may be acquired from GE Specialty Chemicals Company. Exemplary compounds include triphenyl phosphite, diphenyl phosphite, diphenyl isodecyl phosphite, diphenyl isooctyl phosphite and phenyl di-isodecyl phosphite, and mixtures thereof.

The most effective amount of the corrosion inhibitor to be used in accordance with this invention can vary, depending on the local operating conditions and the particular hydrocarbon being processed. Thus, the temperature and other characteristics of the acid corrosion system can have a bearing on the amount of the inhibitor or mixture of inhibitors to be used. Generally, where the operating temperatures and/or the acid concentrations are higher, a proportionately higher amount of the corrosion inhibitor will be required. It has been found that the concentration of the corrosion inhibitor added to the crude oil may range from about 1 ppm to 5000 ppm, by volume. It has also been found that it is preferred to add the inhibitor at a relatively high initial dosage rate of 2000–3000 ppm and to maintain this level for a relatively short period of time until the presence of the inhibitor induces the build-up of a corrosion protective coating on the metal surfaces. The corrosion inhibitor may be added either neat or diluted. Once the protective surface is established, the dosage rate needed to maintain the protection may be reduced to a normal operational range of about 100–1500 ppm without substantial sacrifice of protection.

This invention will now be further described in the following examples, which are provided for illustration purposes and are not intended to act as a limitation thereof.

EXAMPLE 1

A weight loss coupon, immersion test was used to evaluate various compounds for naphthenic acid corrosion in the absence of active sulfur compounds. A paraffinic hydrocarbon oil was deaerated with $N_2$ purge (100 mls/min., for 30 minutes) at 100° C. The temperature was then raised to 260° C., and 10.3 ml of Kodak naphthenic acid (total acid number of the oil: 5.0 mg KOH/g) was added. Shortly thereafter, 1.375 in.$^2$, 1018 carbon steel (preweighed) coupons were suspended in the hot oil on glass hooks. After 18 to 20 hours of exposure (with continuous $N_2$ purge), the coupons were removed, cleaned and reweighed.

Weight losses for untreated coupons exhibit a general corrosion rate of 103±3.0 mpy (mils per year). Table I shows the results of aryl and alkyl phosphite compounds which were evaluated under the above test conditions at 1,000 ppm active.

TABLE I

| Compound | Corrosion Rate Corrosion (mpy) |
|---|---|
| Blank | 103 |
| Comparative Example A | 41.2 |
| phenyl di-isodecyl phosphite | 14.8 |
| triphenyl phosphite | 8.4 |
| isooctyl diphenyl phosphite | 8.2 |
| diphenylphosphite | 6.4 |

Comparative Example A = tri-isooctyl phosphite

As shown above, the substitution of one or more aryl substituents for alkyl substituents yields a significantly greater increase in corrosion inhibition. This effect is independent of the exact substituent group used as reflected by the variety of the samples used.

EXAMPLE 2

A naphthenic acid corrosion test was conducted utilizing the 650° to 850° F. fraction of North Sea Crude Oil. As in Example 1, a weight loss coupon immersion test was used to evaluate corrosion. The total acid number of the solution was 2.3 mg KOH/g. The crude fraction was heated to 565° F. after which the treatment of the invention was added. Two preweighed 1018 carbon steel coupons were then suspended in the hot oil on glass hooks for each run. After 18 to 20 hours of exposure (with continuous $N_2$ purge ), the coupons were removed, cleaned up and reweighed. Weight losses for the coupons from the untreated (blank) run averaged 13.6 mpy. Table II shows the results of the inventive aryl containing phosphite compounds at 440 ppm active.

TABLE II

| Compound | Corrosion Rate Corrosion (mpy) |
|---|---|
| Blank | 13.6 |
| phenyl di-isodecyl phosphite | 1.4 |
| isooctyl diphenyl phosphite | 2.5 |
| tri-phenyl phosphite | 6.6 |
| Comparative Example A | 0.7 |
| Comparative Example B | 24.3 |

Comparative Example A = tri-isooctyl phosphite
Comparative Example B = tri-nonylphenyl phosphite

EXAMPLE 3

In a test procedure similar to Example 2, an atmospheric gas oil fraction from a California refinery was evaluated. Here, however, the aryl containing phosphite compounds were utilized at 150 ppm active and the total acid number of the solution was 1.89 mg KOH/g. The results are shown in Table III.

TABLE III

| Compound | Corrosion Rate Corrosion (mpy) |
|---|---|
| Blank | 25.2 |
| phenyl di-isodecyl phosphite | 2.8 |
| isooctyl diphenyl phosphite | 4.1 |
| Comparative Example A | 3.1 |
| Comparative Example B | 29.7 |

Comparative Example A = tri-isooctyl phosphite
Comparative Example B = tri-nonylphenyl phosphite While the illustrative embodiments of the invention have been described with particularity, it will be understood that various other modifications will be apparent to those skilled in the art without departing from the spirit and scope of the invention.

What I claim is:

1. A method for inhibiting the corrosion of the internal metallic surfaces of the equipment used in the processing of crude oil containing sulfur compounds between about 400° and 790° F. comprising adding to the crude oil a corrosion inhibiting amount of an aryl containing phosphite compound having a structure selected from the group consisting of:

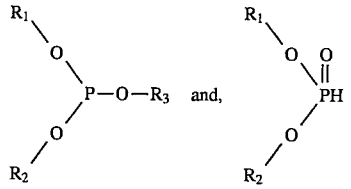

wherein $R_1$, $R_2$ and $R_3$ are $C_6$ to $C_{12}$ and at least one R group is an aryl radical.

2. The method of claim 1 wherein the amount of the aryl containing phosphite compound added to the crude oil is an amount sufficient to generate a concentration of from about 1 to 5000 ppm, by volume.

3. The method of claim 2 wherein the concentration is from about 100 to 1500 ppm, by volume.

4. The method of claim 1 wherein the corrosion is caused by naphthenic acids in the crude oil.

* * * * *